US009980069B2

(12) United States Patent
Hartwell

(10) Patent No.: US 9,980,069 B2
(45) **Date of Patent: *May 22, 2018**

(54) ACOUSTICALLY CONFIGURABLE MICROPHONE

(71) Applicant: INVENSENSE, INC., San Jose, CA (US)

(72) Inventor: Peter G. Hartwell, Menlo Park, CA (US)

(73) Assignee: INVENSENSE, INC., San Jose, CA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/250,438

(22) Filed: Aug. 29, 2016

(65) Prior Publication Data

US 2018/0063661 A1 Mar. 1, 2018

(51) Int. Cl.
*H04R 29/00* (2006.01)

(52) U.S. Cl.
CPC ..... *H04R 29/004* (2013.01); *H04R 2201/003* (2013.01)

(58) Field of Classification Search
CPC ..... H04R 29/004; H04R 2201/003
USPC ..... 381/58
See application file for complete search history.

(56) References Cited

U.S. PATENT DOCUMENTS

| | | | | |
|---|---|---|---|---|
| 7,826,624 | B2 * | 11/2010 | Oxford | H04R 27/00 381/122 |
| 2008/0167868 | A1 * | 7/2008 | Kanevsky | G10L 15/20 704/233 |
| 2011/0142261 | A1 * | 6/2011 | Josefsson | H04R 3/00 381/107 |
| 2014/0321664 | A1 * | 10/2014 | Huang | H04R 29/005 381/92 |
| 2015/0125004 | A1 * | 5/2015 | Cagdaser | H04R 3/00 381/111 |
| 2016/0066113 | A1 * | 3/2016 | Elkhatib | H04R 29/004 381/56 |
| 2016/0157036 | A1 * | 6/2016 | Wiesbauer | H04R 29/004 381/58 |

* cited by examiner

*Primary Examiner* — David Ton
(74) *Attorney, Agent, or Firm* — Amin, Turocy & Watson, LLP

(57) ABSTRACT

Various embodiments provide for an acoustically configurable microphone device that can adjust various parameters affecting sensitivity, acoustic overload point, signal to noise ratio, sample rate, and other parametric choices that affect the performance and function of the acoustic sensor based on commands received via acoustic communications. An acoustic analysis engine can analyze acoustic communications received to determine whether or not the acoustic communication contains a command associated with configuring the microphone. If the acoustic communication is determined to contain a configuration command, a controller on the microphone can implement the configuration command. The acoustic communications can be at ultrasonic frequencies in some embodiments so that the acoustic communications are outside the range of human hearing.

23 Claims, 9 Drawing Sheets

700

| SPEC | HIGH PERFORMANCE MODE (702) | STANDARD MODE (704) | LOW-POWER MODE (706) |
|---|---|---|---|
| Sensitivity | -32 | -30 | -26 |
| SNR | 66dBA | 64dBA | 62dBA |
| AOP | 132 | 126 | 120 |
| Current | 600μA | 400μA | 100μA |

ACOUSTICALLY CONFIGURABLE MICROPHONE

TECHNICAL FIELD

The subject disclosure relates to a programmable microphone that can be configured acoustically.

BACKGROUND

Microphones and acoustic sensors have a variety of parameters that affect the sensitivity, dynamic range, and other sensor behaviors. These parametric choices are traditionally fixed based on the design of the acoustic sensor during the design time or production. If any changes are required to the microphone output, various forms of processing can be performed on the microphone output, but traditionally there has been no way to change the microphone output for a given acoustic input. Furthermore, if any changes were to be made to the microphone, the programming would have to be delivered via a wired line-in connection. This can increase the cost and complexity of circuit boards housing the microphones.

SUMMARY

The following presents a simplified summary of the specification to provide a basic understanding of some aspects of the specification. This summary is not an extensive overview of the specification. It is intended to neither identify key or critical elements of the specification nor delineate any scope particular to any embodiments of the specification, or any scope of the claims. Its sole purpose is to present some concepts of the specification in a simplified form as a prelude to the more detailed description that is presented layer.

In a non-limiting example, a microphone device can comprise a sensor configured to receive an audio communication over a range of audible and non-audible frequencies. The device can also include an audio analysis engine configured to determine that the audio communication comprises a microphone configuration command associated with a microphone setting (or parameter), and in response to determining that the audio communication comprises the command, determining the microphone configuration command. The device can also include a controller configured to configure the microphone setting (or parameter) based on the microphone configuration command.

In another non-limiting example, a method for configuring a microphone device can comprise receiving, by a sensor, an audio signal. The method can also include detecting, by a processor, that the audio signal comprises an identifier indicating that the audio signal comprises a configuration command associated with a microphone device setting. The method can also include determining, by the processor, the configuration command. The method can further include configuring, by a controller, the microphone device to match the microphone device setting based on the configuration command.

In yet another non-limiting example, a system can comprise a host controller configured to generate an audio signal comprising a command identifier and a configuration command associated with a microphone device setting. The system can also comprise a speaker configured to convert the audio signal into an audio communication containing the command identifier and the configuration command. The system can also comprise a programmable microphone configured to receive the audio communication, determine that the audio communication comprises a configuration command based on the command identifier, and configure a parameter to match the microphone device setting based on the configuration command.

The following description and the drawings contain certain illustrative aspects of the specification. These aspects are indicative, however, of but a few of the various ways in which the principles of the specification may be employed. Other advantages and novel features of the specification will become apparent from the following detailed description of the specification when considered in conjunction with the drawings.

BRIEF DESCRIPTION OF THE DRAWINGS

Numerous aspects, embodiments, objects and advantages of the present invention will be apparent upon consideration of the following detailed description, taken in conjunction with the accompanying drawings, in which like reference characters refer to like parts throughout, and in which.

DETAILED DESCRIPTION

Overview

Figure 1:
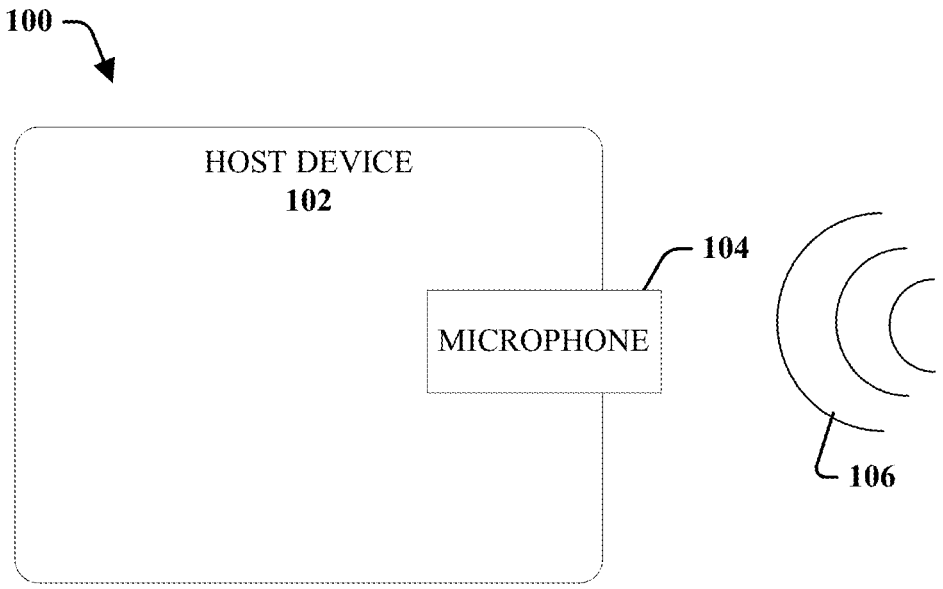
FIG. 1 depicts a programmable microphone embedded in a host device and configured to receive acoustic communication with a configuration command.

While a brief overview is provided, certain aspects of the subject disclosure are described or depicted herein for the purposes of illustration and not limitation. Thus, variations of the disclosed embodiments as suggested by the disclosed apparatuses, systems and methodologies are intended to be encompassed within the scope of the subject matter disclosed herein. For example, the various embodiments of the apparatuses, techniques and methods of the subject disclosure are described in the context of MEMs sensors. However, as further detailed below, various exemplary implementations can be applied to other areas of acoustic sensors with programmable input parameters that can be dynamically programmed based on environmental conditions and ambient noises without departing from the subject matter described herein.

It is further to be appreciated that whilst various features of the subject disclosure are described in various embodiments, the features are not unique to each embodiment—rather different embodiments provide illustrations of ways in which the features are disclosed. Various features described in different embodiments can also be found in other embodiments in which the features are not explicitly described in.

As used herein, the terms MEMS sensor, MEMS acoustic sensor(s), MEMS audio sensor(s), and the like are used interchangeably unless context warrants a particular distinction among such terms. For instance, the terms can refer to MEMS devices or components that can measure acceleration, rate of rotation, a proximity, determine acoustic characteristics, generate acoustic signals, or the like.

Various embodiments provide for an acoustically configurable microphone device that can adjust various parameters affecting sensitivity, acoustic overload point, sample rate, gain, signal to noise ratio and other parametric choices that affect the performance and function of the acoustic sensor based on commands received via acoustic communications. An acoustic analysis engine can analyze acoustic communications received to determine whether or not the acoustic communication contains a command associated with configuring the microphone. If the acoustic communication is determined to contain a configuration command, a controller on the microphone can implement the configuration command. The acoustic communications can be at ultrasonic frequencies in some embodiments so that the acoustic communications are outside the range of human hearing. In an embodiment, a host controller can generate the acoustic communications comprising the configuration commands, and a speaker can broadcast the communication to programmable microphones nearby.

Various other configurations or arrangements are described herein. It is noted that the various embodiments can include other components and/or functionality. It is further noted that the various embodiments can be included in larger systems, including, smart televisions, smart phones or other cellular phones, wearables (e.g., watches, headphones, etc.), tablet computers, electronic reader devices (i.e., e-readers), laptop computers, desktop computers, monitors, digital recording devices, appliances, home electronics, handheld gaming devices, remote controllers (e.g., video game controllers, television controllers, etc.), automotive devices, personal electronic equipment, medical devices, industrial systems, cameras, and various other devices or fields.

Exemplary Embodiments

Various aspects or features of the subject disclosure are described with reference to the drawings, wherein like reference numerals are used to refer to like elements throughout. In this specification, numerous specific details are set forth in order to provide a thorough understanding of the subject disclosure. It should be understood, however, that the certain aspects of disclosure may be practiced without these specific details, or with other methods, components, parameters, etc. In other instances, well-known structures and devices are shown in block diagram form to facilitate description and illustration of the various embodiments.

In the described embodiments Micro-Electro-Mechanical Systems (MEMS) refers to a class of structures or devices fabricated using semiconductor-like processes and exhibiting mechanical characteristics such as the ability to move or deform. MEMS devices often, but not always, interact with electrical signals. MEMS devices include but are not limited to gyroscopes, accelerometers, magnetometers, pressure sensors, microphones, and radio-frequency components.

Silicon wafers containing MEMS structures are referred to as MEMS wafers. The MEMS acoustic sensor includes a MEMS transducer and an electrical interface. In an embodiment, the MEMS transducer and the electrical interface can be fully integrated as single die, or in another embodiment a MEMS transducer and the electrical interface can be two separate dies, where the MEMS transducer and the electrical interface are inter-connected via additional pins and bond wires. In either case, the programmable acoustic sensor is coupled to a host system via electrical interface pins. In embodiments, the host system can be a tester used during production and characterization or an end application that acquires the acoustic sensor output.

FIG. 1 illustrates a non-limiting block diagram 100 of a programmable microphone 104 that is configured acoustically according to various non-limiting aspects of the subject disclosure.

In an embodiment, programmable microphone 104 in a host device 102 can adjust one or more settings based on a configuration command embedded in an acoustic communication 106. In an embodiment, the acoustic communication 106 can be at an ultrasonic frequency at 20 kHz or higher. In other embodiment, other frequencies can be used, including audible frequencies at lower than 20 kHz. In some embodiments, the acoustic communication 106 can even be a subsonic vibration. The sensor settings can include various settings that affect the sound pickup including sensitivity, signal to noise ratio, acoustic overload point, and sample rate, among other parameters.

The microphone 104 can include components and circuitry configured to determine whether or not the acoustic communication 106 contains a configuration command, and if it does, implement the command by configuring the microphone 104 parameters. The microphone 104 can determine whether the acoustic communication 106 contains the configuration command based on an identifier or code embedded in the acoustic communication. The identifier or code can be a readily identifiable sequence of sounds and/or tones. A tone can be, for example, a musical or vocal sound or a sound pressure wave characterized by its pitch, quality, and/or strength. The identifier can be identified based on the sequence and length of each tone or based on the frequencies of the tones. The identifiers can be selected such that the sequence would be unlikely to occur naturally or in the course of regular operation. Following the identifier can be a sequence of tones or sounds that represent the configuration command. In some embodiments, the same identifier or another identifier can follow the configuration command to denote the end of the configuration command.

The configuration command in the acoustic communication 106 can take the form of a series of tones of varying pitch/frequency, length, spacing, and amplitude and can provide instructions to modify discrete microphone settings (e.g., set acoustic overload point to "x"). In other embodiments, the configuration command can contain instructions to load one or more operating modes associated with the microphone 104. For instance, the configuration command can contain an instruction to set the microphone 104 to a high performance mode or low power mode, and the microphone 104 can retrieve the settings associated with the modes from a memory on the microphone 104 in order to implement the configuration command.

In an embodiment, the acoustic communication 106 can originate from a speaker connected to the same device that the microphone 104 is connected to (e.g., host device 102). In other embodiments, acoustic communication can originate from another device.

In some embodiments, there might be multiple programmable microphones within range of the acoustic communication 106. The configuration command in the acoustic communication 106 can be applicable for all the microphones or just a subset of the microphones that receive the acoustic communication 106. The microphones can determine whether the acoustic communication 106 is directed at them based on the identifier or other code transmitted by the acoustic communication 106. In some embodiments, the identifiers can be different and microphone 104 can determine that the configuration command in acoustic communication 106 should be heeded based on matching the identifier to a set of pre-approved identifiers. In other embodiments the identifiers are the same, but code following the identifier and before or after the configuration command can identify the set of microphones to which the acoustic communication 106 applies.

Figure 2:
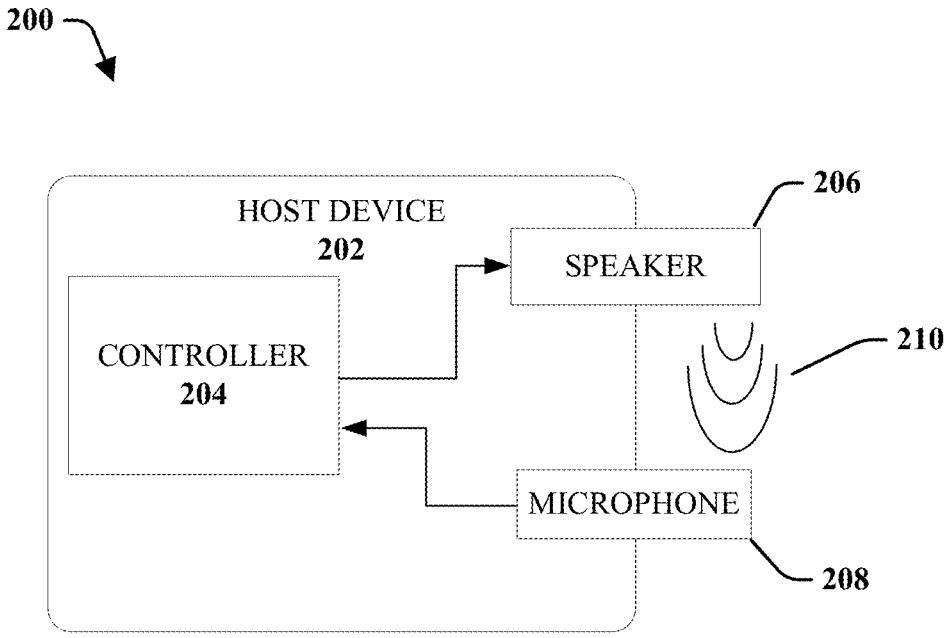
FIG. 2 depicts a programmable microphone embedded in a host device and configured to receive acoustic communication with a configuration command from a speaker also embedded in the host device.

Turning now to FIG. 2, illustrated is a non-limiting block diagram 200 of a system with a speaker 206 and a programmable microphone 208 that is configured acoustically according to various non-limiting aspects of the subject disclosure. Speaker 206 and microphone 208 can both be mounted on a common host device 202. The speaker 206 and microphone 208 can also be mounted on a common logic board or circuit in some embodiments, and in other embodiments be mounted on separate logic boards or circuits. Programming a microphone in traditional methods would require extra cost and complexity in providing wires to the microphone 208 from the controller 204 on host device 202. The microphone 208 would also need to be redesigned to incorporate extra pins on the flex connector to provide a digital interface.

Controller 204 can send an electronic acoustic signal comprising the configuration command and identifiers to the speaker 206 which can convert the electronic acoustic signal to sound waves (e.g., acoustic communication 210). Microphone 208 can receive the acoustic communication 210, convert via a transducer into an electronic signal and then various circuitry on the microphone 208 can analyze the electronic signal to identify whether a configuration command is present and if so, implement the configuration command to adjust one or more settings on the programmable microphone 208. The presence of the configuration command can be indicated by the detection of an identifier, which can be for example a signal of ultrasonic frequency having energy level above at least a pre-determined threshold.

After processing the received electronic signal, microphone 208 can transmit an electronic signal to the controller 204 on the host device via a line out. The controller 204 can determine that the configuration command was received and implemented by the microphone 208 based on changes in the electronic signal that may correspond to the microphone setting changes. In other embodiments, once the configuration command has been implemented by the microphone 208, the microphone 208 can insert a confirmation code into the electronic signal. If the controller 204 does not receive the confirmation code or determine that the changes were implemented, controller 204 can reissue the acoustic electronic signal to the speaker 206 at defined intervals. In other embodiments, the controller 204 can increase the amplitude of the electronic acoustic signal to account for any interference that may have disrupted reception of the acoustic communication 210 by the microphone 208.

Figure 3:
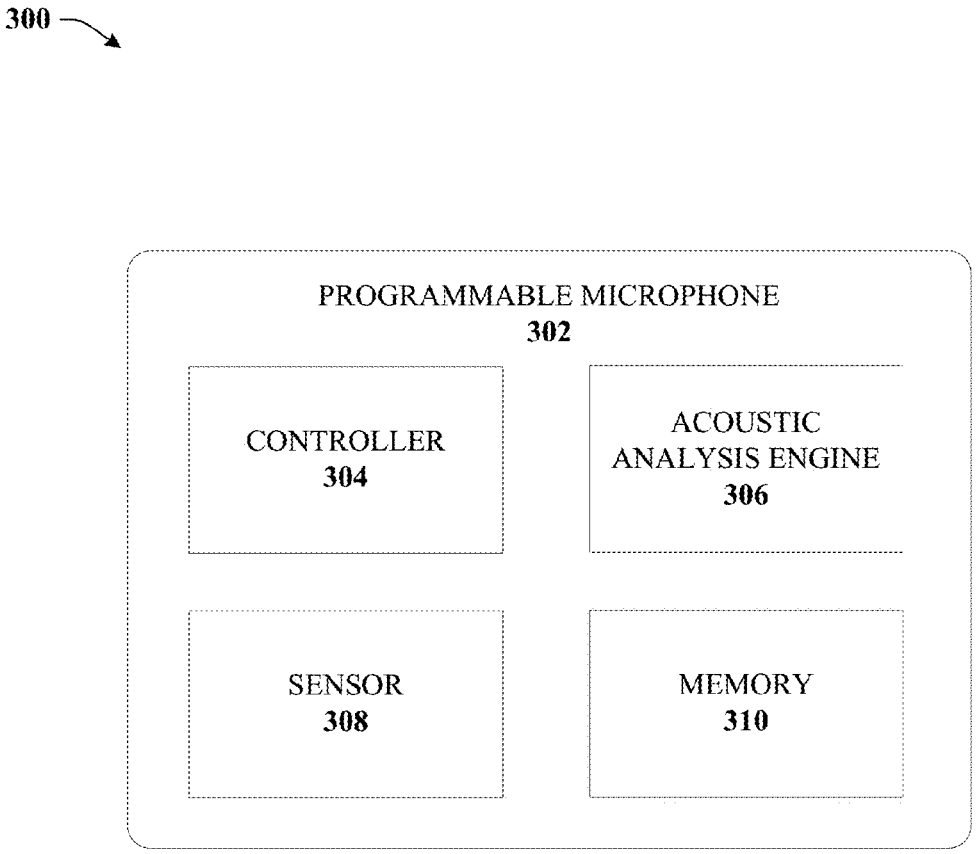
FIG. 3 depicts example block level sensing, control and analyses components of a programmable microphone.

Turning now to FIG. 3, illustrated is a non-limiting block diagram 300 of an acoustically configurable programmable microphone 302 according to various non-limiting aspects of the subject disclosure.

The programmable microphone 302 can include components and circuitry configured to determine whether or not an acoustic communication received by a sensor 308 contains a configuration command, and if it does, implement the command by configuring microphone parameters of microphone 302.

The sensor 308 can include a transducer that converts the sound or acoustic pressure waves into an electric signal and acoustic analysis engine 306 can monitor to the signal to determine whether an identifier is present in the signal that would indicate that the signal contains a configuration command. The acoustic analysis engine 306 can monitor for one or more sets of identifiers stored in a memory 310. If the acoustic analysis engine 306 determines that the electric signal contains an identifier, the acoustic analysis engine 306 can monitor the signal for a predetermined period after the identifier to determine the configuration command. Once the configuration command is determined, controller 304 can implement the configuration command and adjust the microphone settings.

The acoustic analysis engine 306 can determine whether the acoustic communication contains the configuration command based on an identifier or code embedded in the acoustic communication. The identifier or code can be a readily identifiable sequence of sounds and/or tones. The identifier can be identified based on the sequence and length of each tone or based on the frequencies of the tones. The identifiers can be selected such that the sequence would be unlikely to occur naturally or in the course of regular operation. Following the identifier can be a sequence of tones or sounds that represent the configuration command. In some embodiments, the same identifier or another identifier can follow the configuration command to denote the end of the configuration command.

The configuration command in the acoustic communication can take the form of a series of tones of varying pitch/frequency, length, spacing, and amplitude and can provide instructions to modify discrete microphone settings (e.g., set acoustic overload point to "x"). In other embodiments, the configuration command can contain instructions to load one or more operating modes associated with the microphone 302. For instance, the configuration command can contain an instruction to set the microphone 302 to a high performance mode or low power mode, and the microphone controller 304 can retrieve the settings associated with the modes from memory 310 in order to implement the configuration command. In an embodiment, controller 304 can insert a confirmation code into the line out signal or otherwise modulate the line out signal to indicate that the controller 304 has implemented the configuration command.

The acoustic analysis engine 306 can determine whether the acoustic communication is intended for the programmable microphone 302 based on the identifier or other code transmitted by the acoustic communication. In some embodiments, the identifiers can be different and acoustic analysis engine 306 can determine that the configuration command in acoustic communication should be heeded based on matching the identifier to a set of pre-approved identifiers. In other embodiments, the identifier may indicate that the acoustic communication is intended for another programmable microphone and the controller 304 can then ignore the configuration command.

Figure 4:
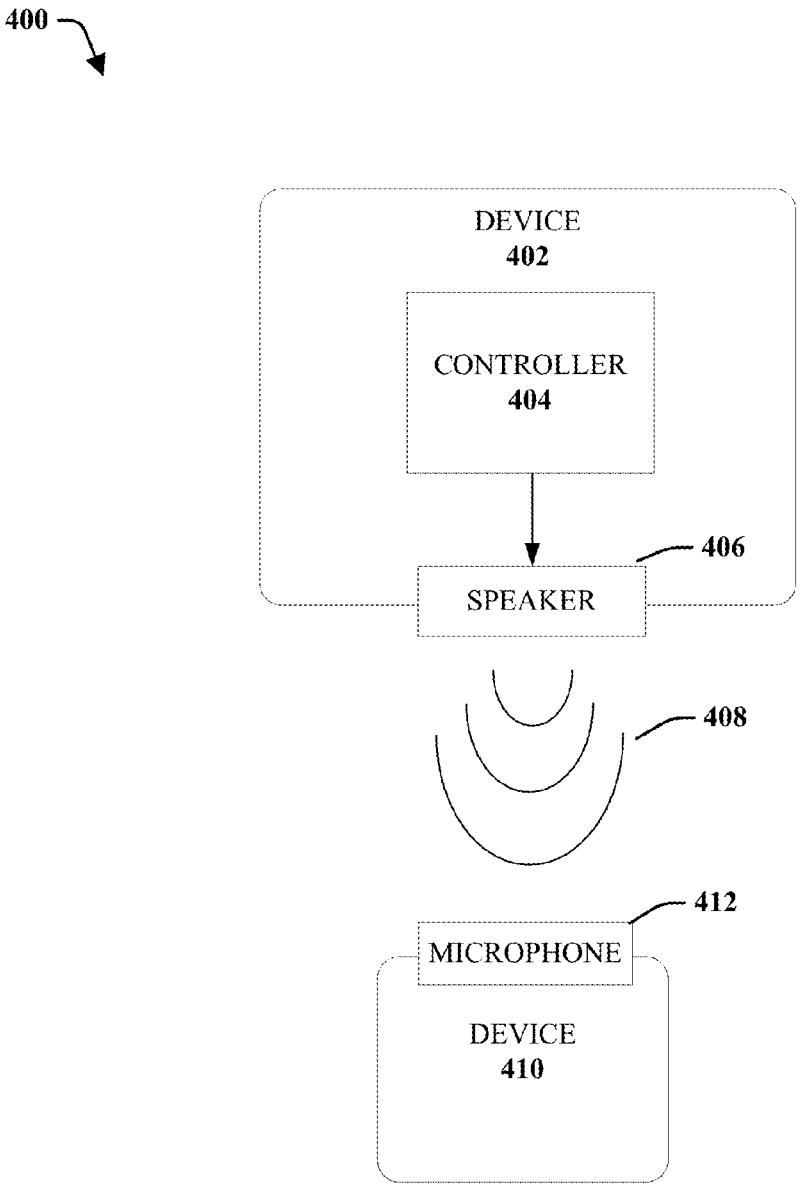
FIG. 4 depicts a programmable microphone embedded in a host device and configured to receive acoustic communication with a configuration command from a speaker embedded in a different host device.

Turning now to FIG. 4, illustrated is a non-limiting block diagram 400 of an acoustically configurable programmable microphone 412 according to various non-limiting aspects of the subject disclosure.

Speaker 406 can be mounted on or within a device 402 and microphone 412 can be mounted on or within another device 410. Controller 404 can send an electronic acoustic signal comprising the configuration command and identifiers to the speaker 406 which can convert the electronic acoustic signal to sound waves (e.g., acoustic communication 408). Microphone 412 can receive the acoustic communication 408, convert via a transducer into an electronic signal and then various circuitry on the microphone 412 can analyze the electronic signal to identify whether a configuration command is present and if so, implement the configuration command to adjust one or more settings on the programmable microphone 412.

Figure 5:
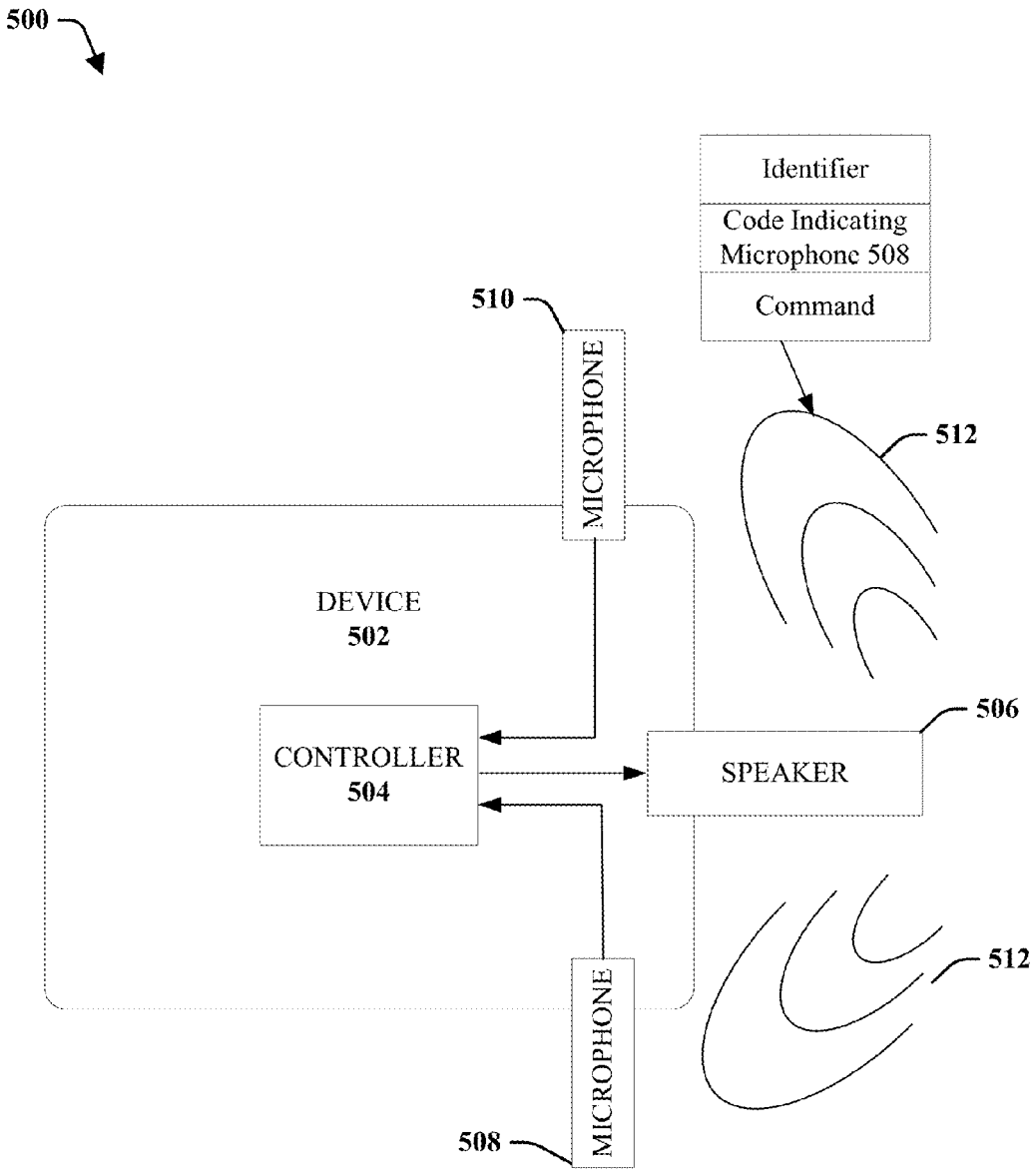
FIG. 5 depicts multiple programmable microphones embedded in a host device and configured to receive acoustic communication with configuration commands from a speaker also embedded in the host device.

Turning now to FIG. 5, illustrated is a non-limiting block diagram 500 of a set of acoustically configurable programmable microphones 508 and 510 according to various non-limiting aspects of the subject disclosure.

Speaker 506 and microphones 510 and 508 can both be mounted on a common host device 502. The speaker 506 and microphones 510 and 508 can also be mounted on a common logic board or circuit in some embodiments, and in other embodiments be mounted on separate logic boards or circuits.

Controller 504 can send an electronic acoustic signal comprising the configuration command and identifiers to the speaker 506 which can convert the electronic acoustic signal to sound waves (e.g., acoustic communication 512). Microphones 510 and 508 can receive the acoustic communication 512, convert via a transducer into an electronic signal and then various circuitry on the microphones 510 and 508 can analyze the electronic signal to identify whether a configuration command is present and if so, implement the configuration command to adjust one or more settings on the programmable microphones 508 and 510.

After processing the received electronic signal, microphones 510 and 508 can transmit an electronic signal to the controller 504 on the host device via a line out. The controller 504 can determine that the configuration command was received and implemented by the microphones 510 and 508 based on changes in the electronic signal that may correspond to the microphone setting changes. In other embodiments, once the configuration command has been implemented by the microphones 508 and 510, the microphones 508 and 510 can insert a confirmation code into the electronic signal. If the controller 504 does not receive the confirmation code or determine that the changes were implemented, controller 504 can reissue the acoustic electronic signal to the speaker 506 at defined intervals. In other embodiments, the controller 504 can increase the amplitude of the electronic acoustic signal to account for any interference that may have disrupted reception of the acoustic communication 512 by the microphones 508 and 510.

The microphones 508 and 510 can determine whether the acoustic communication 512 is directed at them based on the identifier or other code transmitted by the acoustic communication 512. For example, in the embodiment shown in FIG. 5, code embedded in the acoustic communication 512 indicates that the embedded command is for microphone 508. The microphone 508 can thus determine that the configuration command in acoustic communication 512 should be heeded based on matching the identifier to a set of pre-approved identifiers, while microphone 510 determines that the configuration command should be ignored. In other embodiments, code following the identifier and before or after the configuration command can identify whether only one specific microphone (local), a subset of microphones or all microphones (global) as the microphone(s) to which the acoustic communication 512 and the configuration command applies.

Figure 6:
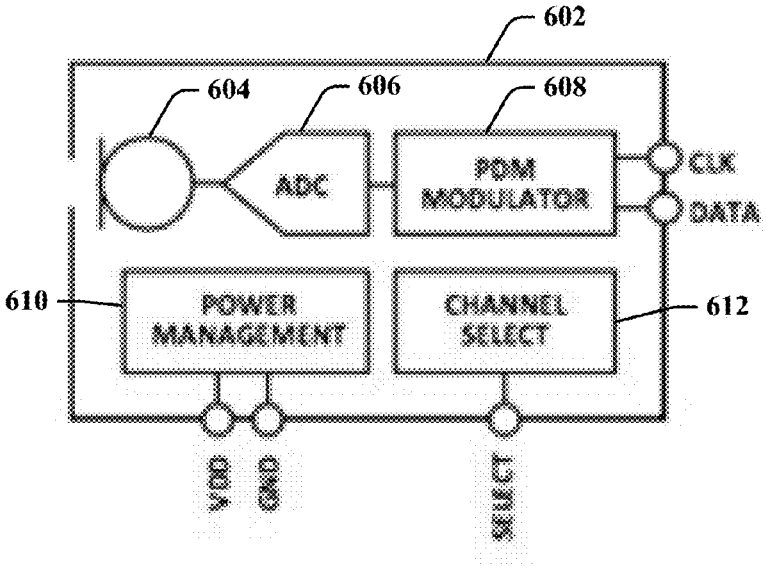
FIG. 6 depicts example signal processing and power management components of a programmable microphone.

Turning now to FIG. 6, illustrated is a non-limiting block diagram 600 of an acoustically configurable programmable microphone 602 according to various non-limiting aspects of the subject disclosure The programmable acoustic microphone 602 includes a transducer 604 that receives acoustic or pressure waves (e.g., the acoustic communication 106 etc) and converts the pressure waves into an analog electrical signal. An analog to digital converter 606 converts the analog electrical signal to a digital electrical signal, and a pulse density modulator (PDM modulator) 608 which performs further processing on the digital electric signal and outputs a Clk and a data line. The programmable microphone 602 can also include power management component 610 which receives power via a VDD and GND pin and a channel select component 612. The programmable microphone 602 can also include components as described in FIG. 3 that perform functions associated with acoustically configuring the programmable microphone 602.

Figures 7, 8:
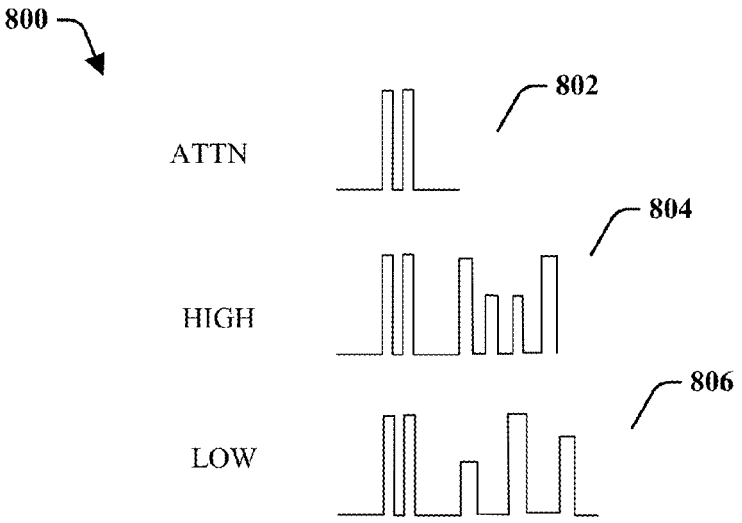
FIG. 7 depicts a table showing example microphone modes for a programmable microphone and example parameters values settings for the various modes.
FIG. 8 depicts example identifiers and configuration commands for a programmable microphone.

Turning now to FIG. 7, illustrated is a non-limiting table 700 showing three microphone modes for the programmable microphone and example parameters and values for those modes. The microphone modes disclosed herein are merely exemplary and in various embodiments the parameters may have different settings and/or values depending on the type of microphone context, and etc.

As an example, microphone mode 702 can be a high performance mode that has various settings for sensitivity, SNR, Current, and acoustic overload point. Each of the microphone modes, high performance 702, standard 704, and low-power 706 can have different parameter settings. These modes are merely exemplary, and in various embodiments, more modes or fewer modes are possible.

A memory (e.g., memory 310) can store the associated parameter settings for each mode, and when the acoustic analysis engine 306 identifies the mode in the configuration command, the controller 304 can retrieve the parameter settings from the memory 310 and implement the parameter settings in the programmable microphone.

Turning now to FIG. 8, illustrated are example identifiers and configuration commands 800 according to various non-limiting aspects of the subject disclosure.

In an embodiment, an identifier can include a predetermined series of tones at various frequencies that indicate that a configuration command follows. In the representation shown here, the ATTN 802 which is the identifier, can comprise two tones at the same pitch that indicate that a configuration command follows. Thus, a first configuration command 804, which can be a command to enter a high performance mode has the ATTN identifier, followed by 4 tones at various pitches. The second configuration command 806, which can be a command to enter a low performance, or low power mode has the ATTN identifier, followed by 3 tones at various pitches. These are merely exemplary configuration commands and identifiers, and in other embodiments, various sequences and tones are possible. Notably the command can include encoded digital data that was encoded by using protocols such as PWM, PDM, PAM, AM, FM, digital spread spectrum and others.

Exemplary Methods

Figure 9:
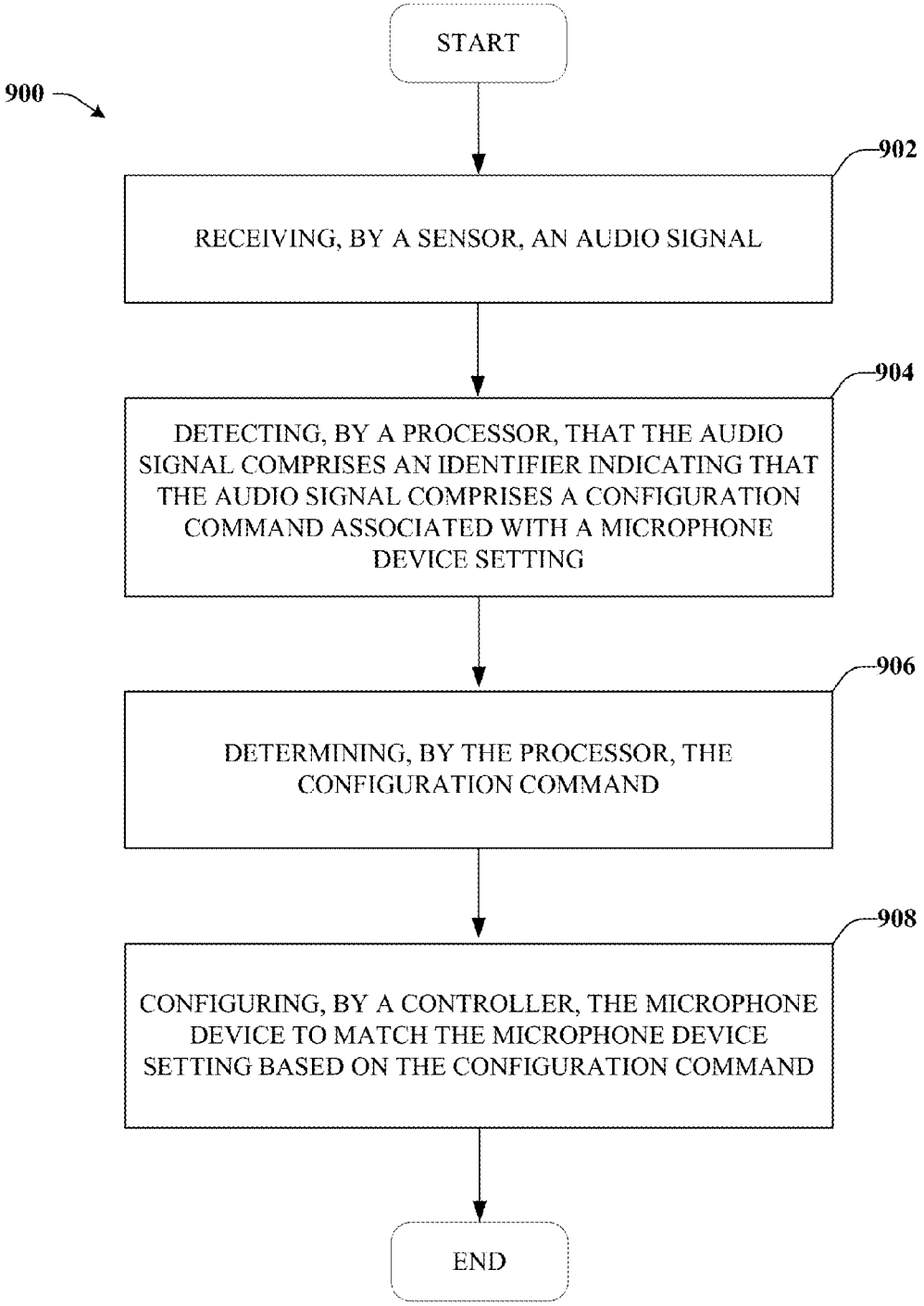
FIG. 9 depicts an example flow diagram for configuration of a programmable microphone.

In view of the subject matter described supra, methods that can be implemented in accordance with the subject disclosure will be better appreciated with reference to the flowchart of FIG. 9. While for purposes of simplicity of explanation, the methods are shown and described as a series of blocks, it is to be understood and appreciated that such illustrations or corresponding descriptions are not limited by the order of the blocks, as some blocks may occur in different orders and/or concurrently with other blocks from what is depicted and described herein. Any non-sequential, or branched, flow illustrated via a flowchart should be understood to indicate that various other branches, flow paths, and orders of the blocks, can be implemented which achieve the same or a similar result. Moreover, not all illustrated blocks may be required to implement the methods described hereinafter.

FIG. 9 depicts an exemplary flowchart of non-limiting methods associated with acoustically configuring a programmable microphone according to various non-limiting aspects of the disclosed subject matter. The method 900 can start at 902 where the method includes receiving, by a sensor, an acoustic signal. The microphone sensor can be a programmable MEMs microphone in some embodiments.

At 904, the method includes detecting, by a processor, that the acoustic signal comprises an identifier indicating that the acoustic signal comprises a configuration command associated with a microphone device setting. The processor can determine that the acoustic signal comprises a configuration command based on an identifier in the acoustic signal. The identifier can be a predetermined sequence of tones at one or more frequencies that indicate that a configuration command follows.

At 906, the method includes determining, by the processor, the configuration command. The configuration command can be another sequence of tones at varying frequencies or use other methods described in the specification following the identifier that are encoded such that decoding the tones provides instructions to adjust microphone settings. The configuration command can be instructions to vary discrete settings such as gain, sample rate, acoustic overload point, etc, or can be instructions to change modes. The microphone can store in a memory settings associated with each mode. At 908, the method includes configuring, by a controller, the microphone device to match the microphone device setting based on the configuration command. In some embodiments, the microphone provides a feedback message or signal to the controller indicating that the command was received and executed.

Exemplary Operating Environment

The systems and processes described herein can be embodied within hardware, such as a single integrated circuit (IC) chip, multiple ICs, an ASIC, or the like. Further, the order in which some or all of the process blocks appear in each process should not be deemed limiting. Rather, it should be understood that some of the process blocks can be executed in a variety of orders, not all of which may be explicitly illustrated herein.

Figure 10:
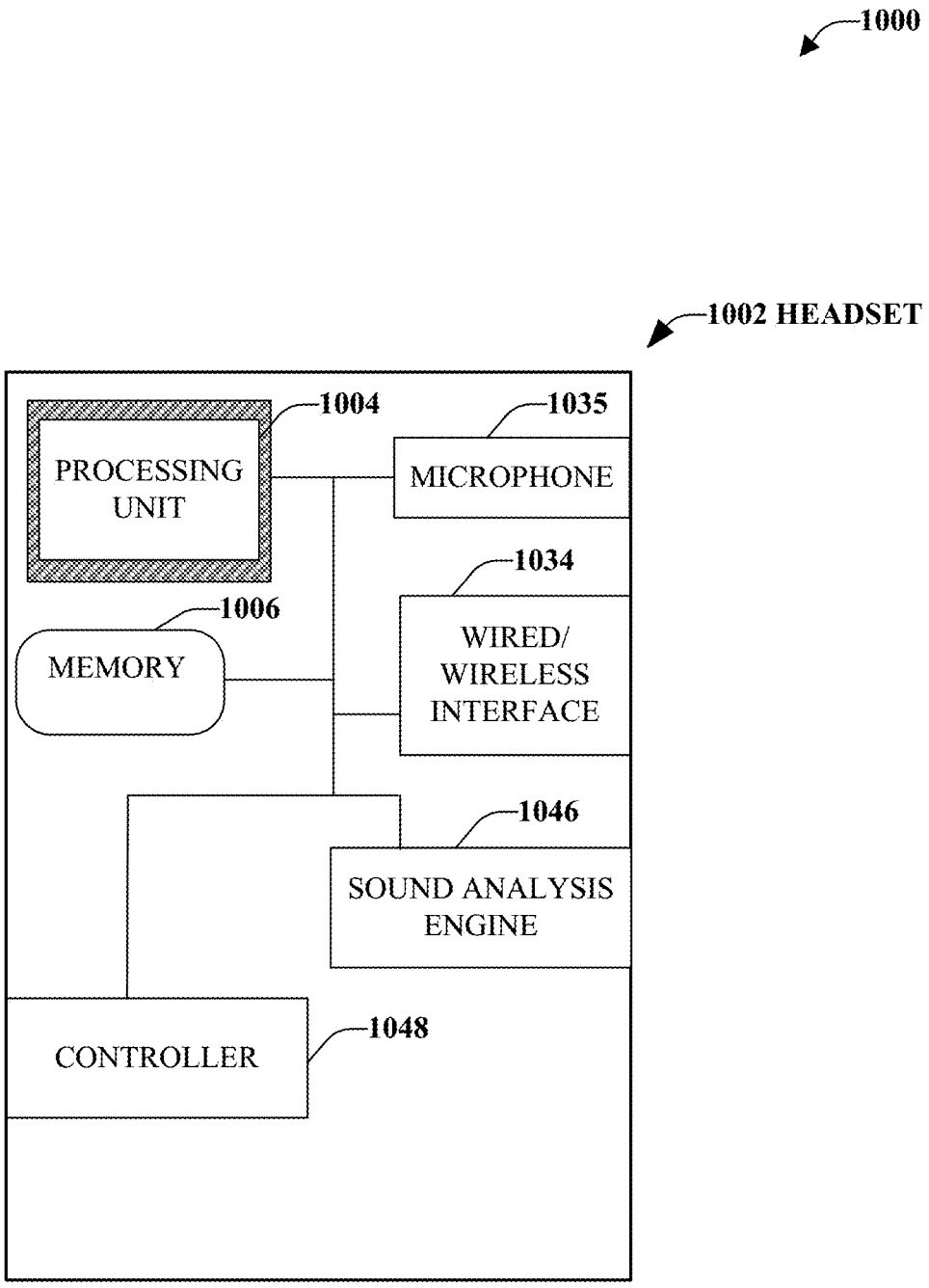
FIG. 10 depicts an example schematic block diagram for a computing environment in accordance with certain embodiments of this disclosure.

With reference to FIG. 10, an exemplary suitable environment 1000 for implementing various aspects of the claimed subject matter includes a headset 1002 having a built-in microphone 1035. The headset 1002 also includes a processing unit 1004, a memory 1006 and a wired/wireless interface 1034 (e.g. for Bluetooth connectivity). The headset 1002 can include the host device 102, 202 and the microphone 1035 can include the microphone 104, 208, 302. The headset 1002 can also include an acoustic analysis engine 1046 and controller 1048 that perform the functions associated with the acoustic analysis engine 306 and controller 304 described above with reference to FIG. 3.

Figure 11:
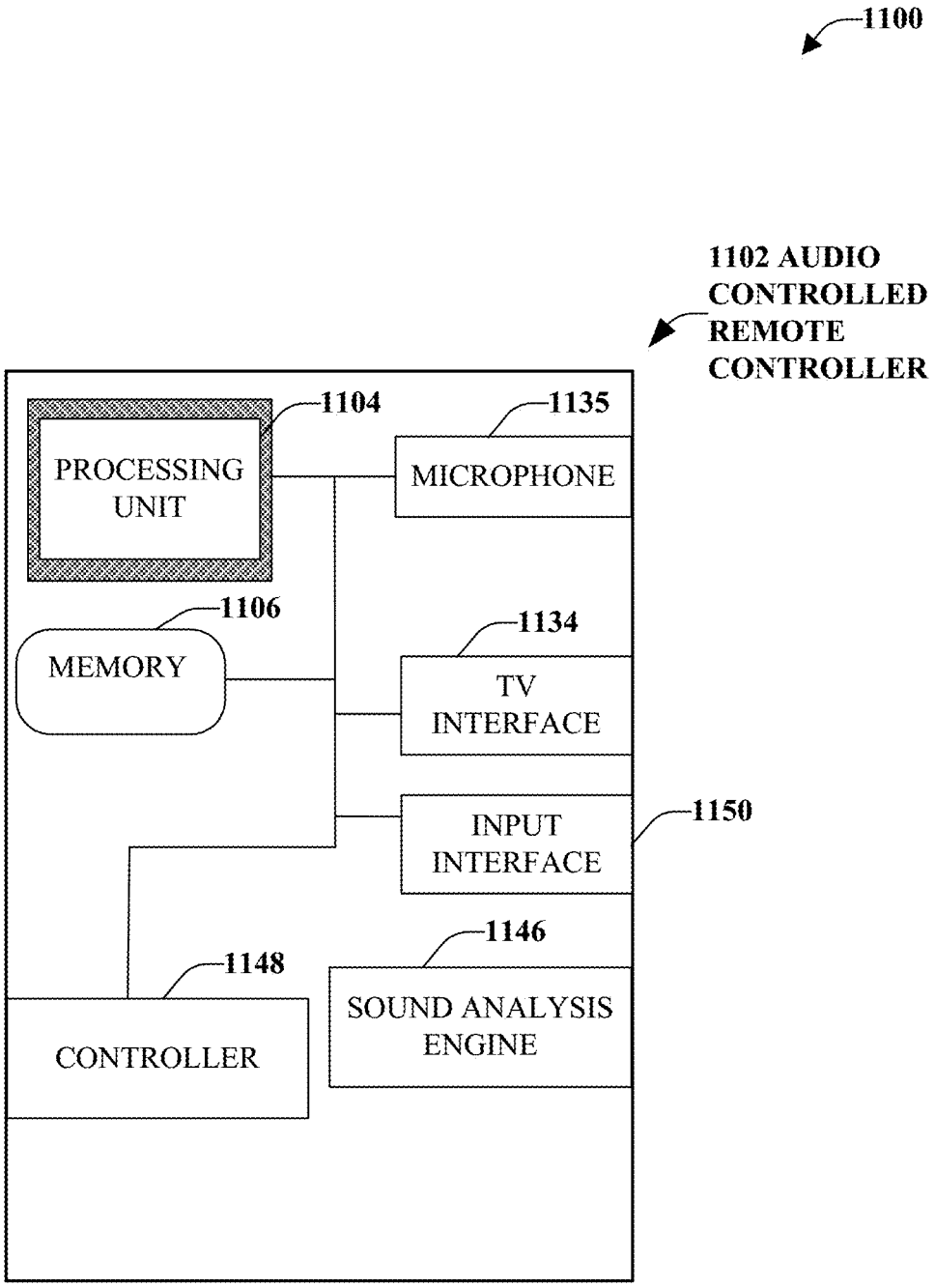
FIG. 11 depicts another example schematic block diagram for a computing environment in accordance with certain embodiments of this disclosure.

With reference to FIG. 11, another exemplary suitable environment 1100 for implementing various aspects of the claimed subject matter is shown. The audio controlled TV remote controller 1102 is shown with a built-in microphone 1135. The microphone 1135 can be used to provide commands or instructions to the controller 1102. The remote controller 1102 also includes a processing unit 1104, a memory 1106, a TV interface 1134 for wirelessly communicating with the TV (e.g. with Bluetooth connectivity) and an input interface 1150 that may include hard or soft keys or buttons. The controller 1102 can include the host device 102, 202 and the microphone 1135 can include the microphone 104, 208, 302. The controller 1002 can also include an acoustic analysis engine 1146 and controller 1148 that perform the functions associated with the acoustic analysis engine 306 and controller 304 described above with reference to FIG. 3.

The illustrated aspects of the disclosure may also be practiced in distributed computing environments where certain tasks are performed by remote processing devices that are linked through a communications network. In a distributed computing environment, program modules can be located in both local and remote memory storage devices.

It is to be appreciated that various components described herein can include electrical circuit(s) that can include components and circuitry elements of suitable value in order to implement the embodiments of the subject innovation(s). Furthermore, it can be appreciated that many of the various components can be implemented on one or more integrated circuit (IC) chips. For example, in one embodiment, a set of components can be implemented in a single IC chip. In other embodiments, one or more of respective components are fabricated or implemented on separate IC chips.

What has been described above includes examples of the embodiments of the present disclosure. It is, of course, not possible to describe every conceivable combination of components or methodologies for purposes of describing the claimed subject matter, but it is to be appreciated that many further combinations and permutations of the subject innovation are possible. Accordingly, the claimed subject matter is intended to embrace all such alterations, modifications, and variations that fall within the spirit and scope of the appended claims.

What is claimed is:

1. A microphone device, comprising:

a sensor configured to receive an acoustic communication;

an acoustic analysis engine configured to determine that the acoustic communication comprises a microphone configuration command that comprises a set of tones associated with a microphone parameter, and in response to determining that the acoustic communication comprises the command, determining the microphone configuration command based on matching the set of tones to a command in a set of commands stored in memory, wherein the commands are distinguished based on at least one of a frequency of the tones, sequence of the tones, and length of the tones; and a controller configured to configure the microphone parameter based on the microphone configuration command.

2. The microphone device of claim 1, wherein the sensor receives the acoustic communication from a speaker that is connected to a circuit that the microphone device is connected to.

3. The microphone device of claim 1, wherein the acoustic communication is at an ultrasonic frequency.

4. The microphone device of claim 1, wherein the acoustic communication is at a subsonic frequency.

5. The microphone device of claim 1, wherein the microphone parameter comprises at least one of sensitivity, acoustic overload point, signal to noise ratio, gain, sample rate and power consumption level.

6. The microphone device of claim 1, wherein the controller is further configured to insert a confirmation signal into an acoustic output signal, wherein the confirmation signal indicates that the controller configured the microphone parameter.

7. The microphone device of claim 1, wherein the acoustic analysis engine is further configured to determine that the microphone configuration command was issued by one of a host device associated with the microphone device or by a host device not associated with the microphone device.

8. The microphone device of claim 1, wherein the microphone configuration command is associated with a microphone mode, and the controller configures a set of microphone parameters based on the microphone mode.

9. A method for configuring a microphone device, comprising:

receiving, by a sensor, an acoustic signal;

detecting, by a processor, that the acoustic signal comprises an identifier of a first predetermined first sequence of tones indicating that the acoustic signal comprises a configuration command comprising a second sequence of tones associated with a microphone device setting;

determining, by the processor, the configuration command based on matching the second sequence of tones to a command of a set of commands stored in memory; and configuring, by a controller, the microphone device to match the microphone device parameter based on the configuration command.

10. The method of claim 9, further comprising:

receiving the acoustic signal from a speaker connected to a device, wherein the microphone device is embedded in the device.

11. The method of claim 9, further comprising:

modulating, by the controller, an output signal of the microphone device to indicate that the controller implemented the configuration command.

12. The method of claim 9, further comprising:

determining, by the processor, that the configuration command was issued by a host device associated with the microphone device.

13. The method of claim 9, further comprising:

determining, by the processor, that another acoustic signal comprises another configuration command from a host device that is not associated with the microphone device.

14. The method of claim 13, further comprising:

ignoring, by the controller, the another configuration command.

15. The method of claim 9, further comprising:

determining, by the processor, that a second acoustic signal comprises a second configuration command directed to another device.

16. The method of claim 15, further comprising:

ignoring, by the controller, the second configuration command.

17. A system, comprising:

a host controller configured to generate an acoustic signal comprising a command identifier and a configuration command associated with a microphone device setting;

a speaker configured to convert the acoustic signal into an acoustic communication;

a programmable microphone configured to receive the acoustic communication, determine that the acoustic communication comprises a configuration command based on the command identifier, and configure a parameter to match the microphone device setting based on the configuration command.

18. The system of claim 17, wherein the host controller is further configured to set an amplitude and a frequency of the acoustic signal based on environmental noise.

19. The system of claim 18, wherein the host controller determines the environmental noise based on input received from the programmable microphone.

20. The system of claim 17, wherein the programmable microphone sends a confirmation signal to the host controller in response to implementing the configuration command.

21. The system of claim 17, wherein the host controller reissues the acoustic signal in response to not receiving a confirmation signal within a predetermined time period after generating the acoustic signal.

22. The system of claim 17, wherein the acoustic communication is at least one of an ultrasonic frequency or a subsonic frequency.

23. The system of claim 17, wherein the microphone device setting comprises at least one of a sensitivity, acoustic overload point, signal to noise ratio, gain, sample rate or power consumption level setting.

* * * * *